United States Patent [19]

Gaetano

[11] 3,945,496

[45] Mar. 23, 1976

[54] MULTIPLE COMPARTMENT THERMALLY INSULATED CONTAINER

[76] Inventor: Camille M. Gaetano, 2720 Broadway 10, San Diego, Calif. 92101

[22] Filed: Oct. 23, 1974

[21] Appl. No.: 517,202

[52] U.S. Cl. ..... 206/546; 206/549

[51] Int. Cl.[2] ..... A45C 11/20

[58] Field of Search ..... 206/546, 549, 543, 544, 206/541

[56] References Cited

UNITED STATES PATENTS

| | | | |
|---|---|---|---|
| 2,057,933 | 10/1936 | Brinkman | 206/541 |
| 2,449,129 | 9/1948 | Kolehmainer et al. | 206/546 |
| 2,499,254 | 2/1950 | Parker | 206/544 X |
| 3,326,357 | 6/1967 | Miller | 206/543 |

*Primary Examiner*—Leonard Summer

[57] ABSTRACT

A multiple compartment thermally insulated container having at least two compartments preferably detachable from each other by luggage-type fasteners; at least one of the compartments having a side door for access to solid or semi-solid food such as stews, puddings, etc. A handle member is removably coupled to one of said compartments and swively coupled to the other of said compartments.

2 Claims, 4 Drawing Figures

MULTIPLE COMPARTMENT THERMALLY INSULATED CONTAINER

BRIEF DESCRIPTION OF THE INVENTION

The present invention relates to a multiple compartment thermally insulated container and more particularly to a multiple compartment thermally insulated container in which at least one of the compartments is adapted for carrying and dispensing solid foods.

According to the invention, a multiple compartment thermally insulated container is provided in which at least two of the compartments are preferably removably attached as by luggage fasteners. At least one of the multiple compartments has a wide door for loading and dispensing from the compartment more solid foods such as stews, puddings, salads, etc. Hence, a complete meal can be carried in a thermally insulated condition instead of the usual liquid such as soups, milk, etc.

An object of the present invention is the provision of an improved multiple compartment thermally insulated container.

Another object of the invention is the provision of a multiple compartment thermally insulated container adapted for carrying and dispensing solid foods.

A still further object of the invention is the provision of a multiple compartment thermally insulated container in which at least one of the compartments is detachable.

Other objects and many of the attendant advantages of the present invention will be readily appreciated as the same becomes better understood by reference to the following detailed description when considered in connection with the accompanying drawing in which like reference numerals designate like parts throughout the FIgures thereof and wherein.

DETAILED DESCRIPTION OF THE DRAWING

Figure 2:
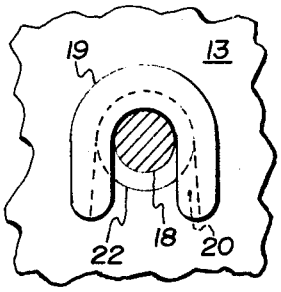
FIG. 2 is a front elevational view of a partially sectioned and broken away portion of the embodiment of FIG. 1.
Figure 1:
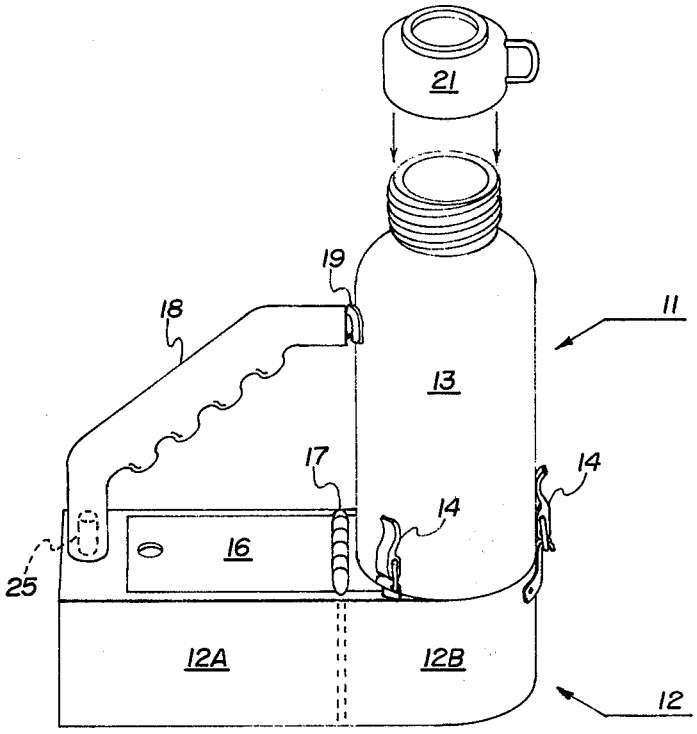
FIG. 1 is a perspective view of the preferred embodiment of the present invention.
Figure 3:
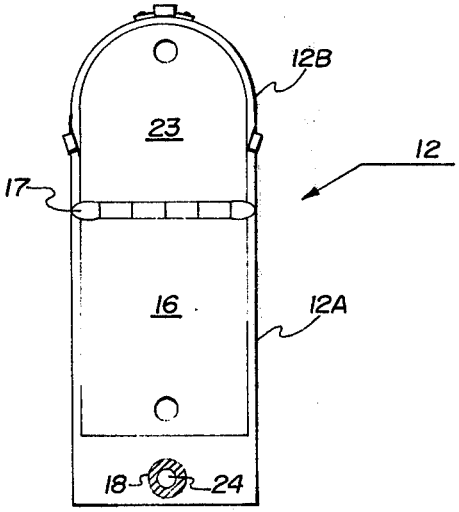
FIG. 3 is a plan view of the bottom compartments of the embodiment of FIG. 1.

Referring to FIGS. 1, 2 and 3, a multiple compartment thermally insulated container is shown generally at 11 having a flat elongated bottom member shown generally at 12 and a top member indicated generally at 13. Bottom member 12 has compartments 12A and 12B therein. Compartment 12b carries top member 13 and is removably attached by luggage-type fasteners 14. Compartment 12A has a door 16 with a hinge 17. Handle member 18 is swivelly and removably attached to the top compartment 12A (FIG. 2) and is captured by a saddle member 19 on top portion 13. A cup 21 forms a cap to top member or compartment 13 and can be threadably attached thereto.

Top member 13 is shown with the top portion of handle member 18 captured within recess 20 on saddle 19 by an extension 22 on handle member 18.

Referring specifically to FIG. 3, bottom member 12 is shown having compartments 12A and 12B with doors 16 and 23, respectively. Doors 16 and 23 are hingedly attached at 17 and 30, respectively. Upward protrusion 24 cooperates with recess 25 in handle 18 to capture handle 18 between bottom member 12 and top member 13.

Figure 4:
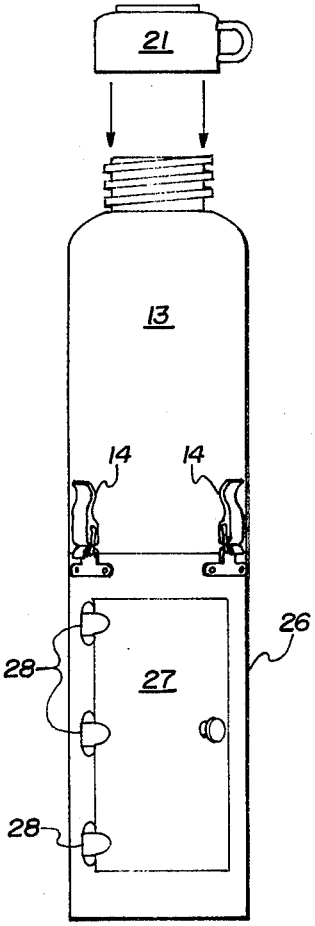
FIG. 4 is a side elevational view of another embodiment of the present invention.

Referring to FIG. 4, top member 13 is shown threaded with cup 21. Top member 13 is carried by bottom member 26 and latched thereto by suitcase-type fasteners 14. Bottom member 26 has an arcuate door 27 hingedly attached at 28.

OPERATION

Referring back to FIGS. 1, 2, and 3, it can be seen that lower member 12 and upper member 13 are removably coupled together by luggage-type fasteners 14. Here it is pointed out that in both the embodiments FIG. 1 and FIG. 4, there are three luggage-type fasteners spaced at approximately 120° apart around the periphery of upper members 13. In use, the lower member 12, having two compartments 12A and 12B, is filled through doors 16 and 23, and due to their flat configuration and extended openings provided by doors 16 and 23, it is contemplated that these compartments will be filled with solid foods such as stew, pudding, salad, etc., while upper member 13 can be filled with a liquid such as coffee, milk, soup, juice, etc. After these compartments have been filled, when in use, the upper member 13 is detached from lower member 12 by uncoupling the fasteners 14 and lifting upper member 13 away. Saddle member 19 then releases extension 22 of handle 18 leaving it free to swivel on upwardly extending protuberance 24 from lower member 12. Handle 18 can be lifted off at this point and the two doors 16 and 23 on lower member 12 can be opened, exposing compartments 12A and 12B. Cup 21, of course, can be removed in the conventional manner from upper member 13.

Referring to FIG. 4, lower member 26 forms one compartment with door 27 hingedly attached at 28. This, of course, would be the solid food compartment as opposed to upper member 13 which is a more or less standard compartment with a cup cap 21 removably attached. Here, again, luggage-type fasteners 14 couple and uncouple upper member 13 to lower member 26.

It should be understood, of course, that the foregoing disclosure relates to only a preferred embodiment of the invention and that it is intended to cover all changes and modifications of the example of the invention chosen herein, for the purposes of the disclosure, which do not constitute departures from the spirit and scope of the invention.

The invention claimed is:

1. A multiple compartment thermally insulated container comprising:

a flat elongated thermally insulated container member dimensioned for carrying solid foods, said flat elongated member having a top flat surface thereon terminating in one end in a circular portion;

at least one door in said top flat surface dimensioned for receiving and dispensing solid foods;

a second thermally insulated container member dimensioned for receiving and dispensing liquid, said second thermally insulated container member being circular in cross section and conforming to the dimensions of said circular portion of said top flat elongated member and being removably coupled to a surface thereof, the said first and second members forming an L shaped assembly when coupled together; and a handle member removably coupled to said second insulated container member and swively coupled to said flat elongated member.

2. The multiple compartment thermally insulated container of claim 1 wherein:

said handle member is swively and removably attached to said flat elongated member.

* * * * *